US006886663B2

(12) United States Patent
Swanenberg et al.

(10) Patent No.: US 6,886,663 B2
(45) Date of Patent: May 3, 2005

(54) DEVICE FOR MOVING A PLATFORM ALONG A FACADE AND BUILDING PROVIDED WITH SUCH A DEVICE

(76) Inventors: Adrianus Cornelis Johannes Maria Swanenberg, Hoosvold 49, NL-6075 DD Herkenbosh (NL); Franciscus Ludovicus Groenendijk, Laan van Wateringseveld 944, NL-2548 CR Den Haag (NL)

( * ) Notice: Subject to any disclaimer, the term of this patent is extended or adjusted under 35 U.S.C. 154(b) by 0 days.

(21) Appl. No.: 10/344,870

(22) PCT Filed: Aug. 14, 2001

(86) PCT No.: PCT/NL01/00597

§ 371 (c)(1),
(2), (4) Date: Feb. 14, 2003

(87) PCT Pub. No.: WO02/14623

PCT Pub. Date: Feb. 21, 2002

(65) Prior Publication Data

US 2003/0178254 A1 Sep. 25, 2003

(30) Foreign Application Priority Data

Aug. 15, 2000 (NL) ..... 1015938

(51) Int. Cl.[7] ..... E04G 1/18; E04G 3/10
(52) U.S. Cl. ..... 182/142; 182/141
(58) Field of Search ..... 182/142, 141, 182/143, 144, 148, 37, 42; 52/37, 29

(56) References Cited

U.S. PATENT DOCUMENTS

| | | | | |
|---|---|---|---|---|
| 3,237,718 A | | 3/1966 | Pearson | |
| 4,538,705 A | | 9/1985 | Leivestad | |
| 4,830,141 A | * | 5/1989 | Montaigne | 182/141 |
| 4,997,062 A | | 3/1991 | Pizzo | |
| 5,127,491 A | * | 7/1992 | Just-Buddy | 182/142 |
| 5,343,979 A | * | 9/1994 | Goto | 182/147 |

FOREIGN PATENT DOCUMENTS

| | | | | |
|---|---|---|---|---|
| DE | 1970938 A | * | 9/1997 | E04G/21/16 |
| GB | 2 263 681 A | | 8/1993 | |

OTHER PUBLICATIONS

International Search Report of PCT/NL01/00597, dated Dec. 18, 2001.
International Preliminary Examination Report of PCT/NL01/00597, dated Sep. 25, 2002.

* cited by examiner

*Primary Examiner*—Hugh B. Thompson, II
(74) *Attorney, Agent, or Firm*—Christie, Parker and Hale, LLP

(57) ABSTRACT

A device for moving a platform at least in vertical direction along a facade (1) of a building defining a front face by a cable (16, 17) which extends along the facade, which device comprises a winding apparatus (14, 15) for the cable, which can be driven by a driving apparatus, and a guide for causing the cable (16, 17) to extend vertically along the facade on the outer side thereof, wherein an apparatus for moving the guide in such a manner that the guide pass the front face.

17 Claims, 4 Drawing Sheets

DEVICE FOR MOVING A PLATFORM ALONG A FACADE AND BUILDING PROVIDED WITH SUCH A DEVICE

CROSS-REFERENCE TO RELATED APPLICATIONS

This application is a 371 of PCT/NL01/00597, filed Aug. 14, 2001.

DESCRIPTION

The invention relates to a device for moving a platform at least in vertical direction along a facade of a building defining a front face by means of a cable which extends along said facade, which device comprises winding means for said cable, which can be driven by driving means, and guide means for causing the cable to extend vertically along the facade on the outer side thereof.

Such a device is generally known and is used on relatively high buildings, such as office buildings, in particular those buildings that have flat facades and a flat roof. Such devices, which are present on top of the flat roof of the building in question, are made up of a trolley which moves over a guide, such as a rails, which is mounted on the flat roof and which extends in horizontal direction parallel to the facade. A winch for a cable is mounted on the trolley. The cable extends from said winch to a guide, such as a pulley. Said guide is present on the end of an arm which extends from the trolley on the flat roof inwards of the front face to a position outwards of the frontface, which enables the cable to extend downwards from said guide on the outer side of and along the facade. Normally, two such devices are present, whereby the trolley is used jointly by the two devices. A platform is attached to the ends of the cables associated with each of the respective devices, under said guides, which platform is capable of accommodating a person for the purpose of said person carrying out work on the facade, in particular work such as the cleaning of windows of the building, from the outside thereof. The cables can be wound and unwound by operating the two winches, as a result of which the platform is moved vertically along the facade. The platform can also be moved in horizontal direction by moving the common trolley along the guide, so that in principle the entire facade area is accessible from the platform. Usually, a safety cable is provided in addition to the aforesaid cables, and possibly also an electric cable, which cables extend between the winch and the platform via the end of the aforesaid arm, like the other cables.

As an aside it is noted that within the framework of the invention cables can be made of any suitable material, such as steel or a plastic material, for example, whilst the term cable is to be understood to include also other kinds of flexible, elongated pulling means, such as a chain. The front face is the, in principle unlimited, surface that coincides with the outer side of the facade.

The use of the above-described devices according to the prior art impose considerable restrictions on the architectural freedom in designing a building, for example because the roof must be at least partially flat. In addition to that, the fact that the device according to the prior art is exposed to view, even when not in use, is considered undesirable for aesthetic reasons, as it mars the visual quality of a building.

The object of the invention is to provide a device according to the introduction, which on the one hand gives an architect a greater degree of freedom in the design of a building, whilst on the other hand the device is not exposed to the view of the public, or at least to a lesser extent, when it is not in use. This objective is accomplished in that the device, according to the invention comprises means for moving the guide means in such a manner that said guide means pass the front face. When said guide means pass the front face, they reach one side of the front face from the other side of the front face. Movement of the guide means to the side of the front face that faces towards the building, which movement is effected by said moving means, makes it possible to hide said guide means from the view of the public, or at least from the members of the public who are present at ground level. By moving the guide means to the side of the front face that faces away from the building, the entire device can be placed in the operative position and the cable can be unwound by the unwinding means, so that said cable will extend along the facade, on the outer side thereof. The use of such a device makes it possible to enhance the architectural quality of the building, whilst the architect will furthermore have greater freedom of design.

A very advantageous embodiment of the device is obtained if said guide means are at least partially made up of said winding means. This implies that the winding means, which in general can be made up of a winch, can be moved by said moving means between one side of the front face and the other. The preferred embodiment that is described herein enables a very compact construction.

The movement of the guide means by the moving means can be realised in various ways. Think in this connection of an arm being swung out by pivoting it about a horizontal pivot extending parallel to the front face. A constructionally simple and thus advantageous embodiment is in particular obtained if the moving means are arranged for translating the guide means substantially in horizontal direction. This can be effected by means of a rolling or sliding movement, for example.

Preferably, a motor is used for moving the platform, which motor is mounted on said platform and which is suitable for passing the cable therethrough. Motors of this kind, which are known per se, comprise means for engaging the cable and rotation means. In such an embodiment, the cable and the platform are not moved jointly. Initially, the cable is unwound until the lower end thereof is located at the level of a loose platform. This level will generally correspond to the ground level. At this level the cable is passed through the motor, whereby the cable is engaged by the engaging means. When the motor, more specifically the rotation means, are driven, the motor, and consequently also the platform, will move upwards or downwards along the cable. A major advantage of the use of such an embodiment is that the winding means, or at least the driving means for said winding means, can be of relatively light construction, since they only need to be suitable for winding and unwinding the cable, which is not loaded by a platform. After all, the vertical movement of the platform is effected by the motor, which is mounted on the platform. As a result, the winding means and the driving means can also be smaller, which is advantageous in connection with the extent to which they are exposed to view and with the limited amount of space which such a device takes up, which makes it easier to incorporate it in the design of a building. An additional advantage is the fact that the motor, which is relatively heavily, does not form an inherent part of a building and that consequently the manager of the building in question need not be burdened with the maintenance of the motor.

In order to enhance the ease of operation, the device is preferably provided with wireless control means for operating the moving means and/or the driving means by remote control. This can take place from the ground level, for example. An additional advantage is that it is not necessary to walk on the roof, which reduces the risk of damage to the roof in the form of leakage, for example, whilst also safety is enhanced.

The invention furthermore relates to a building comprising a facade and a roof, which building is fitted with a device as described above.

A very advantageous embodiment of such a building, by means of which the advantages of the device according to the invention can be utilized optimally, is characterized in that part of the facade is movable so as to make it possible for the guide means to be moved by the moving means. To this end, the movable part of the facade can for example be tilted aside in the form of a hatch, or the movable part can be moved jointly with the guide means. When the guide means are positioned on the inner side of the front face, said guide means can be fully hidden from view behind the movable part of the facade.

A constructionally and aesthetically advantageous embodiment is obtained if the facade of the building is provided with cladding panels, and the movable part of the facade comprises at least one cladding panel. When the guide means occupy a retracted position, they will not mar the appearance of the building.

A very advantageous embodiment of the building in combination with the device is obtained if the moving means are at least partially incorporated in an upper level floor of the building. Within the framework of this invention, the term upper level floor is understood to include the floor of a roof. A major advantage of incorporating said moving means at least partially in an upper level floor is that the upper side of the roof does not need to be available for installing winding means and unwinding means thereon. This allows a greater freedom as regards the shape of the roof, which does not need to be flat, at least not necessarily so.

According to a preferred embodiment, the moving means comprise pressure means for operation between the building and the guide means. Such pressure means may for example consist of a single-action or double-action hydraulic or pneumatic piston/cylinder assembly, wherein the guide means are mounted on the end of a piston rod.

A constructionally simple embodiment can be realised if said pressure means comprise a spring, preferably a compression spring.

Especially if a compression spring is used, which tends to push the guide means to the side of the front face that faces away from the building, it is very advantageous if the moving means comprise an elongated, flexible pulling element, such as a (second) cable, which is connected to the guide means or to the building, as well as pulling means for pulling in the flexible pulling element against the action of the pressure means so as to cause the guide means to pass the front face in the direction of the building. Said pulling means could for example consist of a winch that is especially intended for this purpose.

Another advantageous embodiment of the building is characterized by two devices according to the invention as described above, guides on the roof for said two devices and connecting means for interconnecting the two devices, wherein the length of said connecting means is adjustable for the purpose of adjusting the mutual distance between the two devices. The adjustable mutual distance makes it possible to move platforms of different dimensions, as may be suitable for different purposes, vertically along the facade.

The invention will be explained in more detail hereafter in the description of two preferred embodiments, wherein reference is made to the following figures.

Figure 1:
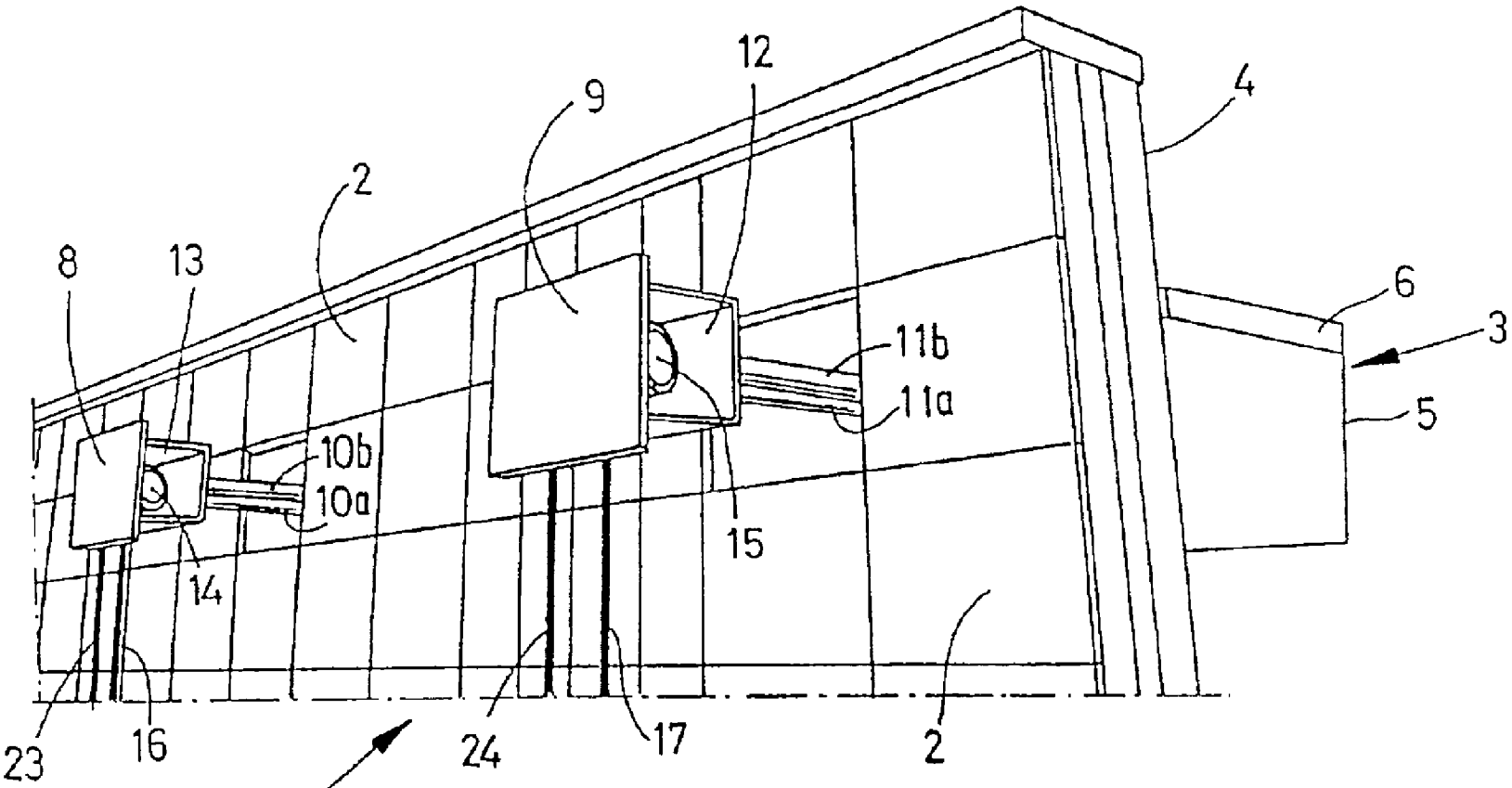
FIG. 1 is a perspective view of the first embodiment.
Figure 2:
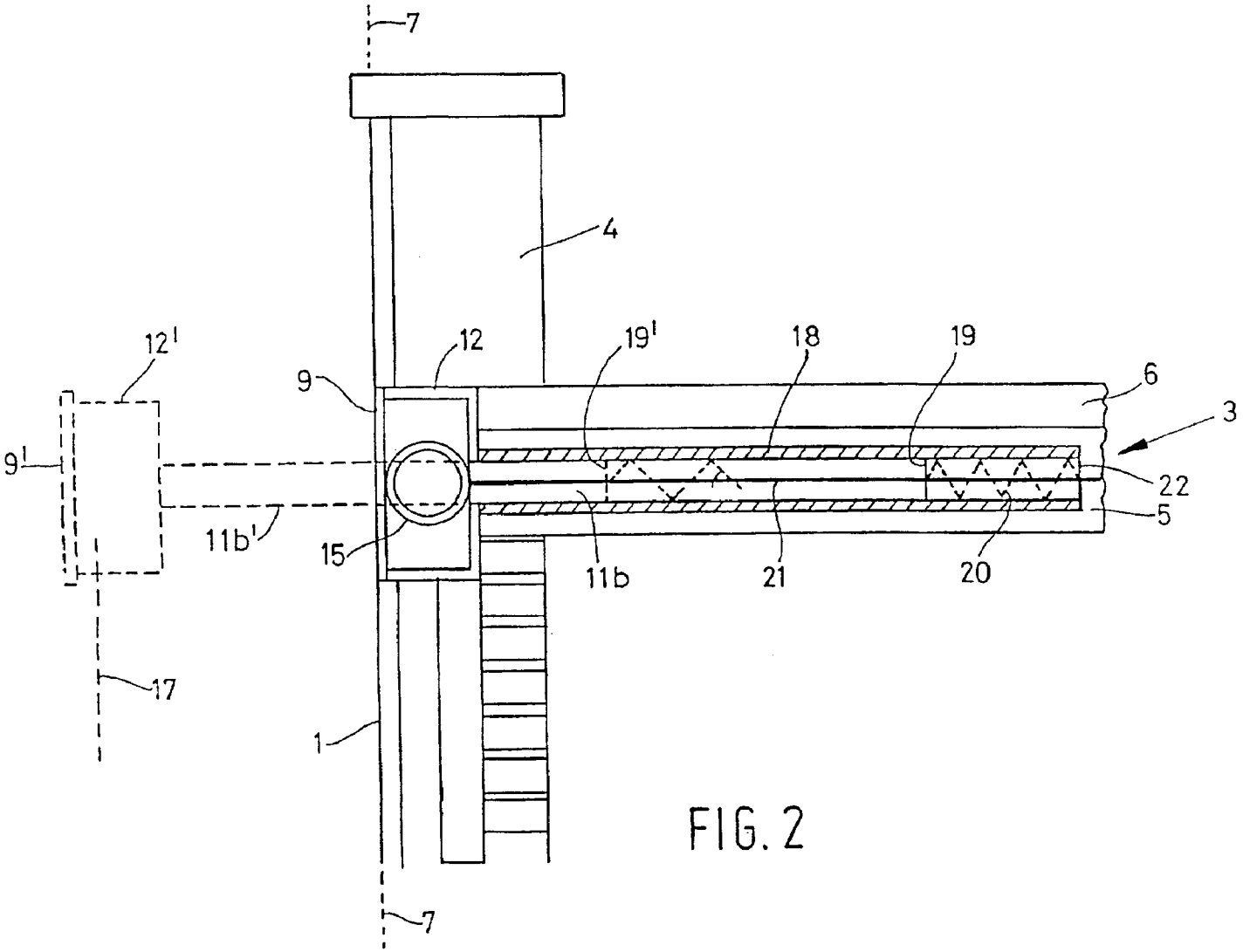
FIG. 2 is a schematic, cross-sectional view of a slightly altered version of said first embodiment.

FIGS. 1 and 2 show a facade 1 at the level of the upper side of a multi-storey building. The facade is clad with square cladding panels 2, of which only the extensible cladding panel 9 is shown in FIG. 2. The side wall, which extends perpendicularly to the facade 1 of the building, is not shown in FIG. 1 for the sake of clarity. This makes it possible to show the roof construction 3. Above the roof construction 3, facade 1 forms a parapet 4, which is slightly higher in FIG. 2 than in FIG. 1. Roof construction 3 is built up mainly of a concrete floor 5, on which an insulating layer 6 is present. As is known by those skilled in the art, roofing material is present on top of insulating layer 6. Facade 1 defines a front face 7 on its outer side. In the situation as shown in FIG. 1, two cladding panels 8, 9 are each extended by means of two telescopic sliding tubes 10*a*, 10*b* and 11*a*, 11*b*, respectively. Cladding panels 8, 9 are connected to said tubes by means of U-shaped brackets 12, 13. Present within U-shaped brackets are winches 14, 15, from which a hoisting cable 16, 17 can be unwound, so that said hoisting cables 16, 17 extend vertically along facade 1. FIG. 2 shows a vertical section of sliding tube 11, wherein sliding tube 11*b* is illustrated in retracted position as well as in extended position (in dotted lines). In the case of the extended position, the numerals in question are provided with an accent mark. A horizontal bore is formed in the concrete floor 5, which bore is lined by a tube 18, as it were. Said tube 18 functions as a guide for sliding tube 11*b*. A compression spring 20 is present between the end 22 of the horizontal bore in concrete floor 5 and the end 19 of sliding tube 11*b*, under the influence of which spring the sliding tube 11*b* tends to slide outwards. Present besides winch 15 is a second winch (not shown), whose axis of rotation is co-axial with that of winch 15. A pull cable 21 is wound on said winch, which pull cable is with its free end connected to the roof construction 3, near the end of the horizontal bore that is present therein, via the interior of sliding tube 11*b* and compression spring 20. Pull cable 21 prevents sliding tube 11*b* from being slid outwards together with winch 15 and cladding panel 9 under the influence of compression spring 20. When pull cable 21 is unwound from the aforesaid second winch (not shown), sliding tube 11*b* will move outwards, together with the parts connected thereto, thus creating the situation that is illustrated in dotted lines in FIG. 2. From this extended position, hoisting cable 17 can be unwound from winch 15. Said hoisting cable 17 can be used together with hoisting cable 16 for moving a platform vertically along the facade, from which platform work can be carried out, such as the cleaning of windows.

Furthermore, a third winch is provided for every winch 14, 15, on which third winch a safety cable 23, 24 is wound for safety reasons, and possibly also a feeder cable for supplying electric power to a platform. Said third winch is likewise co-axial with winches 14, 15.

Figure 3:
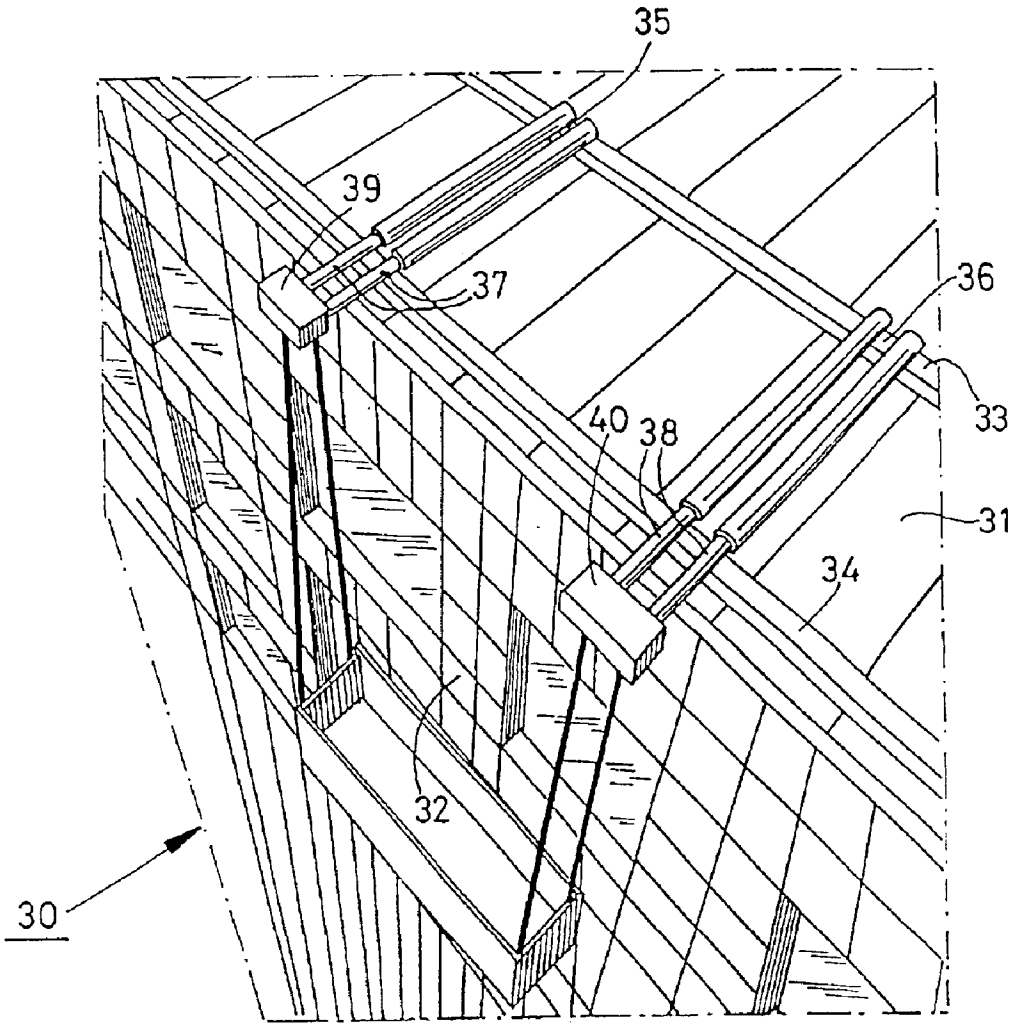
FIG. 3 is a perspective view of the second embodiment.

Although the sliding tubes are mounted within in the roof construction 3 in the embodiment that is shown in FIGS. 1 and 2, it is very well possible to position said tubes elsewhere, for example directly under the roof construction 3 or on the roof construction 3. A possible embodiment of the latter situation is shown in FIG. 3, which shows the office building 30 in perspective view from its upper side. On roof 31, parallel to facade 32, two guides 33, 34 are mounted some distance apart. Two pairs or tubes 35, 36 extending perpendicularly to said guides can be moved along said guides by moving means (not shown). The tubes of each pair of tubes 35, 36 are interconnected, whilst preferably also the pairs of tubes are interconnected by means of a connecting member, whose length can be adjustable, so that the distance by which the pairs of tubes 35, 36 are spaced apart is likewise adjustable. Sliding tubes 37, 38 are movable in their longitudinal direction within the tubes of said pairs of tubes, in such a manner that winches 39, 40, which are mounted on the front end of sliding tubes 37, 38, can be moved between a position on the front side of facade 32 to a position on the rear side, or the building side, of facade 32. This makes it possible to hide winch 39, 40 from sight in the retracted position, whilst it is possible to unwind a hoisting cable 41, 42 from winches 39, 40 in the extended position. The movement of the sliding tubes 37, 38 can take place in the manner that is illustrated in FIG. 2.

A remote control unit is used for controlling the driving means, for retracting and extending the sliding tubes, as well as for controlling the various winches, wherein the range of said remote control unit is sufficiently large for carrying out said control from ground level.

Figure 4:
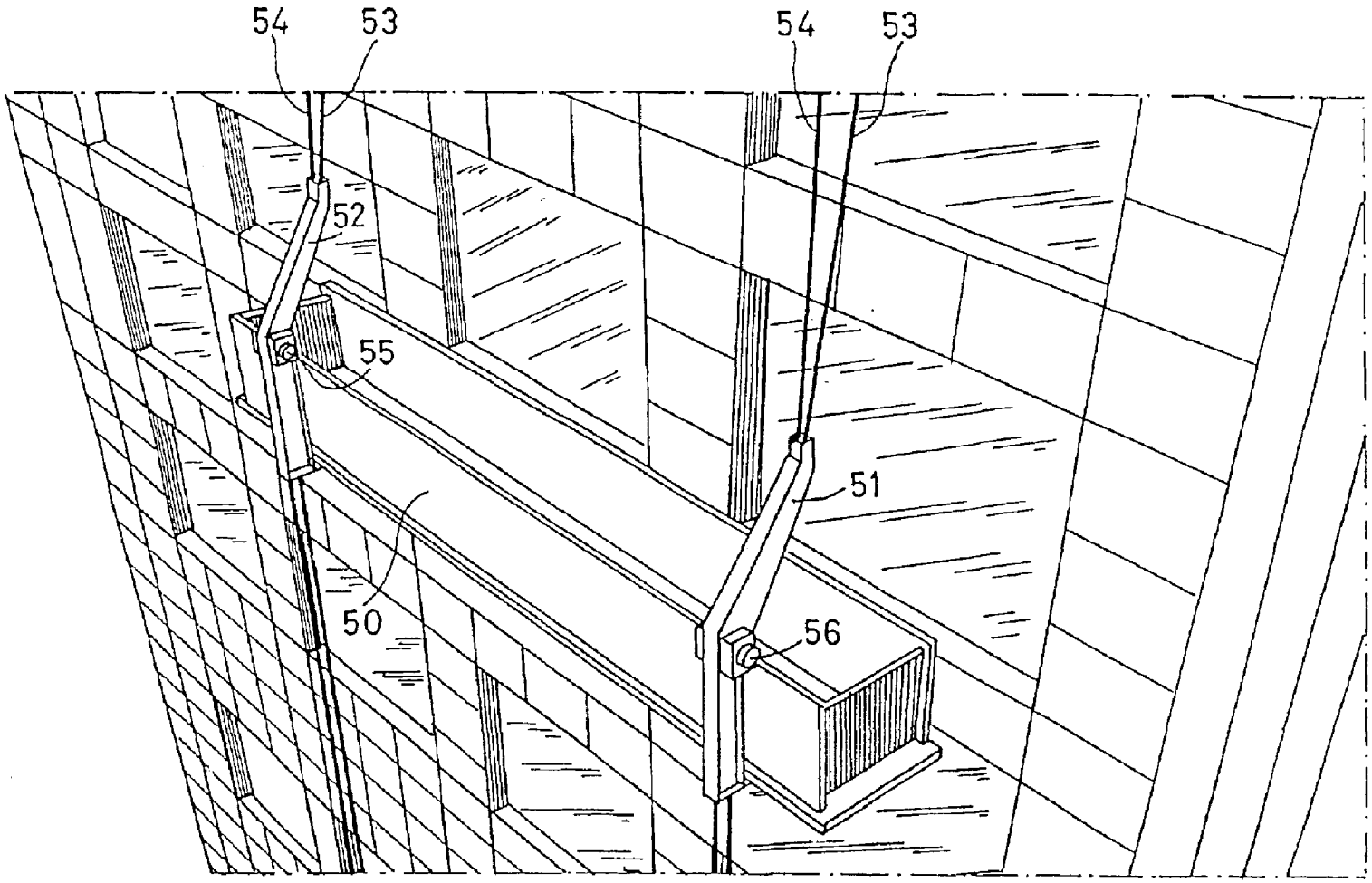
FIG. 4 shows a platform as can be used both with the first and with the second embodiment.

With regard to the vertical movement of platforms, it is very advantageous if a platform as shown in FIG. 4 is used. Mounted on both ends of platform 50 are guides 51, 52 for hoisting cables 53 as well as for safety cables 54. Present within guides 51, 52 are engaging means 55, 56 which are known per se, which engaging means can engage the cables 53 and move with respect to hoisting cables 53 by rotating their engaging parts. This makes it possible to have platform 50 move upwards and downwards without attendant vertical movement of hoisting cables 53. It will be apparent that in such an embodiment, wherein the winch on which hoisting cable 53 can be wound, can be of lighter construction than a winch which must also effect the vertical movement of the platform. The term hoisting cable is not entirely correct in this respect, because the hoisting cable is not directly used for moving the platform in vertical direction.

The invention is not restricted to the embodiments as described above with reference to the drawings, the scope of the invention is defined by the claims hereinafter. In an alternative embodiment, a situation is conceivable wherein it is not the winch associated with a hoisting cable that is movable between the inner side and the outer side of a front face, but a guide, such as a guide wheel for the hoisting cable. In addition thereto it is possible within the framework of the invention, for example, to attach the platform in question to the lower end of the hoisting cable. In that case, the winch on which the hoisting cable is wound can be used for moving the platform in vertical direction, with the hoisting cable and the platform moving jointly. It is emphasized that it is possible to use the invention during the construction of a building already for carrying out work on the facade, for example the fitting of cladding panels.

What is claimed is:

1. A building comprising:

a facade defining a front face and a roof; and at least one device connected to the building for moving a platform in at least a vertical direction along said front face of the facade, wherein said at least one device comprises:

a cable adapted to be coupled to the platform, winding means for winding said cable, driving means for driving the winding means, guide means for guiding the cable, and moving means for moving the guide means from a retracted position to an extended position, wherein in the extended position the guide means extends outwardly from the front face of the facade and guides the cable vertically along the front face of the facade, and wherein a portion of the front face of the facade is movable to allow the guide means to be moved by the moving means.

2. The building according to claim 1, wherein the front face of the facade of the building is provided with cladding panels, and wherein the movable portion of the front face of the facade comprises at least one cladding panel.

3. The building according to claim 1 or 2, wherein said moving means is at least partially incorporated in a floor of the building.

4. The building according to claim 1, wherein said moving means comprises pressure means for moving said guide means between the retracted and extended positions.

5. The building according to claim 4, wherein said pressure means comprises a spring.

6. The building according to claim 5, wherein said moving means comprises an elongated, flexible pulling element, which is connected at one end to either the guide means or to the building, and at another end to pulling means for pulling the flexible pulling element against the action of the pressure means so as to cause the guide means to move between the retracted and extended positions.

7. The building according to claim 1, wherein the at least one device comprises two devices, each moveably mounted to at least one guide on said roof, and further comprising adjustable connecting means connected to each of the two devices and adjustable in a lengthwise direction for the purpose of adjusting a distance between the two devices.

8. The building according to claim 1, wherein the at least one device is arranged for operating the moving means and the driving means by remote control from a ground level of the building.

9. The building according to claim 1, wherein said guide means comprises said winding means.

10. The building according to claim 1, wherein said moving means is arranged for translating said guide means substantially in a horizontal direction.

11. The building according to claim 1, wherein the platform comprises engaging means, which comprises rotation means, for engaging the cable so as to move the platform along the cable that extends along the facade.

12. The building according to claim 11, wherein the at least one device is arranged for operating the moving means and the driving means by remote control from a ground level of the building.

13. The building according to claim 12, further comprising wireless control means for the remote control of the moving means and the driving means.

14. The building according to claim 1, wherein in the retracted position the guide means is disposed inwardly from the front face of the facade.

15. The building according to claim 14, wherein in the retracted position the guide means is not visible from a position exterior to the building.

16. The building according to claim 1, wherein said moveable portion of the front face of the facade is removably coupled to the building to allow the guide means to be moved by the moving means when the movable portion of the facade is removed from the building.

17. The building according to claim 1, wherein said moveable portion of the front face of the facade is coupled to and movable with said guide means.

* * * * *